United States Patent [19]

Swindall et al.

[11] 4,325,437

[45] Apr. 20, 1982

[54] ANVIL WITH TRAPPED FLUID

[75] Inventors: William S. Swindall, Cambridge, Canada; Anil Mahyera, Salt Lake City, Utah

[73] Assignee: Joy Manufacturing Company, Pittsburgh, Pa.

[21] Appl. No.: 144,739

[22] Filed: Apr. 28, 1980

[51] Int. Cl.[3] ..... B25D 9/04

[52] U.S. Cl. ..... 173/131; 60/583

[58] Field of Search ..... 173/131, DIG. 4, 116; 267/125, 137; 60/583, 593

[56] References Cited

U.S. PATENT DOCUMENTS

| | | | |
|---|---|---|---|
| 841,972 | 1/1907 | Huber | 60/583 |
| 2,649,691 | 8/1953 | Johnson | 60/583 |
| 3,315,470 | 4/1967 | Clews | 60/583 |

FOREIGN PATENT DOCUMENTS

| | | | |
|---|---|---|---|
| 471102 | of 0000 | France | 60/583 |
| 640860 | 4/1928 | France | 60/583 |

*Primary Examiner*—Werner H. Schroeder
*Assistant Examiner*—Andrew M. Falik
*Attorney, Agent, or Firm*—William J. O'Rourke, Jr.

[57] ABSTRACT

A hydraulic impactor having a reciprocating piston, a liquid coupling having a stepped bore and an actuatable driven member of a configuration to obtain the optimum energy transfer to the driven member.

4 Claims, 1 Drawing Figure

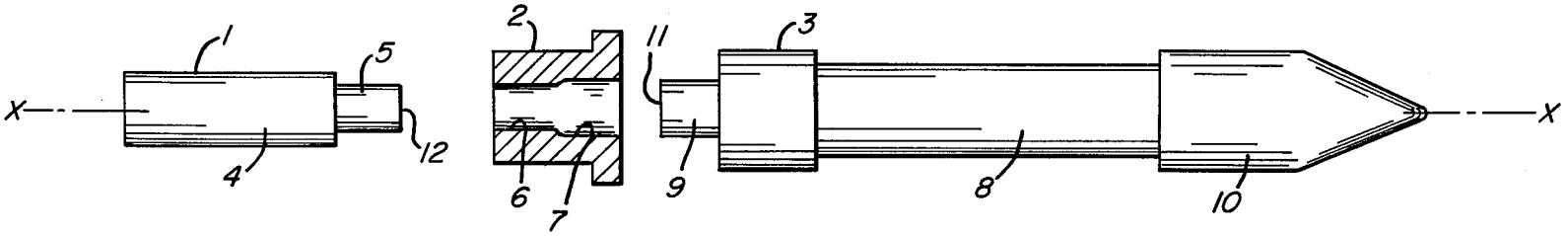
X
10
8
3
9
11
7
2
6
12
5
4
1
X

ANVIL WITH TRAPPED FLUID

BACKGROUND OF THE INVENTION

1. Field of the Invention

This invention relates to the structure of hydraulic devices in which energy is transmitted through a liquid coupling from an actuatable drive member to a driven member. More specifically the invention relates to hydraulic impactors in which the drive piston is hydraulically coupled to a driven striker bar and bit through a coupling having a stepped through bore with the end of the bore cooperable with the striking bar being in a fixed ratio with respect to the other end of the bore cooperable with the piston.

2. Description of the Prior Art

Applicants are not aware of any prior art directed to the hereindescribed invention; however, hydraulic impactors to which the invention is applicable are well known. No prior art search was conducted with respect to this invention and the individual inventors did not recall any prior art publications having a relevancy sufficient to warrant an investigation as to whether the inventors' recollections were correct. The individual inventors are aware that various prior art publications exist with respect to impactors and energy transfer through a liquid but not of any publication which is relevant to the instant invention beyond that which is generally known in the field of the invention. Hydraulic impactors with a liquid coupling are shown in U.S. Pat. Nos. 4,166,507, Re 27,244, and 4,062,268; however, these patents as understood do not relate to maintaining a ratio between the areas at the opposite ends of a liquid coupling.

SUMMARY OF THE INVENTION

The invention of this application is to a structure having a selected relationship between the hydraulically active or hydraulically effective areas of hydraulically coupled drive and driven members dependent solely upon the weight of the drive and driven members to obtain an optimum transfer of energy from the drive member to the driven member.

Accordingly one object of this invention is to optimize the transfer of energy from an actuatable drive member hydraulically coupled to a driven member.

Another object of this invention is to maintain a ratio of the hydraulically effective areas of hydraulically coupled drive and driven members to obtain an optimum transfer of energy.

Still another object of this invention is to determine the ratio of the hydraulically effective areas of hydraulically coupled drive and driven members of various hydraulic devices with respect to the mass or weight of the drive and driven members to provide the optimum transfer of energy from the drive member to the driven member.

These and other objects of this invention will be better understood upon considering and understanding the following description of an embodiment of the invention as illustrated in the accompanying drawing.

BRIEF DESCRIPTION OF THE DRAWINGS

FIG. 1 is an exploded illustrative showing of a hydraulic coupling between drive and driven members constructed in accordance with the principles of this invention.

DESCRIPTION OF THE PREFERRED EMBODIMENT

The invention described herein was developed for use with hydraulic hammers or impactors in which the kinetic energy of a reciprocable piston 1 is transferred through a hydraulic coupling 2 to a driven member 3. Such a hydraulic impactor is shown in U.S. Pat. No. 4,089,380 (see also companion U.S. Pat. Nos. 4,062,268 and 4,012,909) and the disclosure of each of such patents is incorporated herein for a more detailed showing and description of the structure and operation of a hydraulic impactor having hydraulically coupled drive and driven members. The identified patents illustrate a hydraulic coupling having a cylindrical liquid chamber or tappet the opposite ends of which slidably receive an end portion of the piston and an end portion of a driven member respectively. Although not shown in the identified patents a stepped liquid chamber wherein the cross sectional area of the hudraulically effective area of the driven member 3 is larger than the cross sectional area of the hydraulically effective area of the piston 1 has also been used heretofore. The piston 1 is reciprocally activated so that during its work stroke it enters the coupling 2 to pressurize the hydraulic fluid captive therein and which pressurized fluid is effective upon the driven members 3 to actuate the driven member 3.

More specifically the piston 1 comprises an elongated cylindrical major portion 4 having an outwardly extending cylindrical portion or nose 5 of a smaller diameter than the major portion 4. To simplify the understanding of the structure of this invention the direction in which the nose 5 extends from the major portion 4 is hereinafter referred to as forward with the opposite direction being rearward. Such reference directions are accurate with reference to the showing in FIG. 1; however, hydraulic hammers are operated with the piston 1 being reciprocal along an axis that may be located in any position within the capability of the support for the hydraulic hammers. Coupling 2 is an elongated formed member having a central longitudinally extending through bore therein with the rearward portion 6 being of smaller diameter than the forward portion 7. Driven member 3 comprises an elongated formed striker bar 8 having a rearwardly extending cylindrical stem portion 9 and a forward end secured by suitable means (not shown) to an impactor bit 10. Nose 5 is closed slidably received within the rearward bore portion 6 during each work stroke of the reciprocating piston 1 and the stem portion 9 is closely slidably received within the forward bore portion 7 during the reciprocation of the piston 1. Inasmuch as the kinetic energy of the piston 1 is being transferred to the driven member 3, piston 1, bores 6 and 7 and driven member 3 are constructed to be coaxially located on a common axis XX. Nose 5, upon each entry into the bore portion 6, prevents the hydraulic fluid from being discharged from the coupling 2 during each work stroke so that as the nose 5 continues its forward movement in bore portion 6 the pressure of the hydraulic fluid within the bore of the coupling 2 is increased and is effective upon the rearward face 11 of the stem portion 9 to drive the driven element 3 forwardly. Normally in such operation the forward end of the bit 10 is out of engagement with some object or substance, such as rock which is to be broken, which object or substance constitutes the load against which the bit 10 is effective upon striking the object or substance. Thus, the kinetic energy of the piston 1 is utilized to pressurize the hydraulic fluid in the coupling 2 which pressurized hydraulic fluid is effective upon the face 11 to drive the bit 10 into striking engagement with the load. Since the hydraulic fluid is pressurized between a forward face 12 of the nose 5 and the face 11 of the striker bar 8, faces 12 and 11 constitute the hydraulically active or hydraulically effective areas of the piston 1 and driven member 3 respectively and the central bore of the coupling 2 functions as a hydraulic coupler or hydraulic tappet between the faces 12 and 11.

The structure and operation of the piston 1, coupling 2 and driven member 3 to the extent previously described are well known and further description thereof is not believed to be necessary for those skilled in the art of hydraulically coupled hammers or impactors. Such prior structures have not provided as efficient a transfer of energy as is obtained with the structure of this invention.

By studies and actual experimentation it has been determined that an improved transfer of energy occurs when the ratio of the hydraulically effective area of face 12 to the hydraulically effective area of face 11 is equal to the square root of the ratio of the weight of piston 1 to the weight of the bit 10 plus the weight of the striker bar 8. Thus, the optimum energy transfer occurs when the:

$$\frac{\text{Hydraulically effective area 12 of the nose 5 of piston 1}}{\text{Hydraulically effective area of the stem portion 9 of striker bar 8}} = \sqrt{\frac{\text{weight of piston 1}}{\text{weight of bit 10 + weight of striker bar 8}}}$$

or more simply:

$$\frac{\text{area 12}}{\text{area 11}} = \sqrt{\frac{\text{piston weight}}{\text{driven member weight}}}$$

Alternatively such relationship can be expressed as the area 12 equals the area 11 times the square root of the piston weight divided by the driven member weight i.e.

$$\text{area 12} = \text{area 11} \sqrt{\frac{\text{piston weight}}{\text{driven member weight}}}$$

Inasmuch as verification of the above relationship has been obtained by experimentation the full range through which the weight ratio applies for determining the area relationship has not been established. From experimentation it is known that the relationship is true for

| Example | Piston Weight Pounds | Bit Weight Pounds | Striker Bar Weight Pounds |
|---|---|---|---|
| 1 | 94 | 90 | 160 |
| 2 | 46.6 | 40 | 125 |
| 3 | 5.5 | 7 | 30 |
| 4 | 10 | 12 | 38 |

The same optimum energy transfer was obtained when a striker bar was considered as the piston.

From a practical standpoint when designing the coupling 2 the piston weight, striker bar weight and bit weight may be fairly well known. In many instances a previously used drive system for piston 1 will be used with different known tools so that the piston weight, striker bar and bit weight are essentially known; however, the exact weights will require determination. For example, if a previously used piston is to be used, proper calculation will be required to determine the ratio for areas 11 and 12. Once the areas 11 and 12 are determined the diameters of areas 11 and 12 can be determined and, in turn, the diameters of bore portions 6 and 7. In instances where a new hammer is to be designed, the size and weight of the drive member including the piston equivalent to piston 1 will be established by the commercial requirements for the drive member including its size, weight and maneuverability. Similarly, experience indicates the approximate size and weight required for a striker and bit for use in a particular environment. An exercise of judgement is also required to determine the diameters of bore portions 6 and 7 to insure that the proper volume of liquid is contained within the coupling 2 to prevent the piston 1 from striking the coupling 2 or the nose 5 from striking the stem portion 9 during the work stroke i.e. overstroking. Nor can the difference in the piston 1 and driven member 3 weights be so large as to cause excessive rebounding of the piston 1 as energy dissipated in rebounding the piston 1 is not available to drive the driven member 3 thus resulting in a less efficient transfer of energy through the coupling 2. Thus, in determining the diameters of bore portions 6 and 7 the ratio of the areas 11 and 12 is also restricted by the length of the piston work stroke and the volume of liquid required in the bore portions 6 and 7 to prevent the piston 1 from impacting the coupling 2 or the area 12 from impacting the area 11 and the amount of piston rebound dependent upon piston weight.

Another factor which must be taken in account is the change in weight which will occur in the bit 10 as the bit 10 becomes worn in normal service such as rock breaking. With the 90 pound bit of Example 1 which is used in rock breaking, the cost of bit replacement versus loss of efficient energy transfer over the coupling 2 requires consideration. The diameters of bore portions 6 and 7 for optimum energy transfer are determined by the weight ratio as expressed above which weight ratio will change as the bit weight drops from 90 to say 60 pounds due to bit wear. If desired the bore portions 6 and 7 can be calculated for an 90 pound bit and permitting the efficiency to decrease as the bit 10 wears away. Alternatively, the bore portions 6 and 7 can be calculated for a mean or average weight of 75 pounds for the bit 10 so that the energy transfer increases as the bit weight drops from 90 to 75 pounds and decreases as the bit weight decreases from 75 to 60 pounds. Such determinations are the compromises that a designer faces; however, with the relationship of areas 11 and 12 as set forth herein the designer will be better able to select the diameters for bore portions 6 and 7 for individual hammer designs.

Since the weight ratio of the piston to the driven member 3 determines the proper ratio for the areas 11 and 12, greater latitude in design is provided by providing for a variable weight piston 1. One such variable weight piston is attained by providing an open-ended bore extending inwardly from the rearward end of the piston 1. Suitable plug means are provided for closing the rearward end of such bore. With such structure the weight of piston 1 can be "fine tuned" by extending the bore length when less piston 1 weight is desired or by filling the bore in whole or in part with a heavier substance such as lead when greater piston 1 weight is desired.

In order to obtain the optimum energy transfer with the area ratio heretofore described it is necessary that the driven member 3 be accelerated to the maximum velocity possible with relation to the available energy input by the piston 1 prior to the bit 10 striking the load. In practice the forward end of bit 10 is spaced from the load a distance from one quarter ($\frac{1}{4}$) to one (1) inch and such distances are sufficient to obtain such maximum velocity of the driven member 3. In the event the driven member 3 does not achieve such maximum velocity, energy will still be imparted to the load when the bit 10 strikes the load; however such energy transfer will not be the optimum with relation to the available energy input of the piston 1. Thus, in practice a specific structure of hydraulically coupled impactor will require the bit 10 to be spaced from the load a sufficient distance to permit the optimum energy to be transferred and such distances will vary depending upon the available energy input of the piston 1. With some existing hydraulic impactors their structure is such that the bit 10 is hydraulically biased into engagement with the load by the pressurized fluid utilized to position the piston 1 to initiate a work stroke. In such impactor structures the bit 10 is moved away from the load upon the release of such pressurized fluid so that the bit 10 is positioned to permit the optimum energy to be transferred. The term available energy input defines the energy available to the driven member 3 as due to leakage, seal wear, fit etc. the total kinetic energy of the piston 1 is not necessarily effective to drive the driven member 3.

In operation a hydraulically coupled impactor produces a pressure pulse which in the trapped fluid within the coupling 2 travels from ahead of the nose 5, upon nose 5 entering the bore portion 6, to be effective upon the area 11. With the stepped bore of this invention such pressure pulse during optimum energy transfer is lower in magnitude than the pressure pulse of prior such impactors; particularly those in which the coupling corresponding to coupling 2, has a uniform cross section such as shown in the prior art previously identified herein. Such pulses in uniform cross section bores are in the nature of ten percent higher than the pulses of this invention. Such lower magnitude of pulse permits the stresses induced into the coupling 2 and its supporting structure to be reduced or, if the stress level in an existing structure is well below the maximum that a component can accommodate, smaller sectioned components can be used.

Whereas particular embodiments of the invention have been described above for purposes of illustration it will be evident to those skilled in the art that numerous variations of the details may be made without departing from the invention as defined in the appended claims. Specifically it is recognized that the exact ratio of areas to obtain the maximum energy transfer need not be employed to obtain an improved energy transfer. Thus, for example, a less than perfect utilization of the available energy of piston 1 may be acceptable and still provide a commercially acceptable hydraulically coupled impactor. Further it is to be recognized that areas 12 and 11 are hydraulically effective areas, that is, the areas exposed to the pressure of the liquid within the coupling 2 as is well known in hydrostatic devices. Consequently, although the nose 5 and the stem portion 9 are preferably cylindrical portions as shown and described, the actual configuration of the nose 5 and the stem portion 9 may be varied as desired within the known principles of hydrostatic devices.

What is claimed is:

1. In a hydraulic impactor of the type in which a coupling having a stepped through bore transfers energy through a liquid from a reciprocating piston to a driven member by having an extending nose portion of the piston impact upon a liquid within the coupling when the nose portion enters the bore from one end while an extending stem portion of the driven member is slidably received within the other end of the bore the improvement comprising, said nose portion having the cross sectional area of the portion thereof having the largest cross sectional area equal to the cross sectional area of the largest cross sectional portion of said stem portion times the quantity equal to the square root of the weight of said piston divided by the weight of said driven member.

2. A hydraulic impactor as set forth in claim 1 wherein said nose portion and said stem portion are cylindrical portions.

3. A hydraulic impactor as set forth in claim 1 wherein said driven member comprises a striker bar and a bit.

4. A hydraulic impactor as set forth in claim 1 wherein each of said largest cross sectional areas are equal in cross sectional area to the hydraulically effective areas of said nose portion and said stem portion.

* * * * *